United States Patent [19]

Gotou et al.

[11] Patent Number: 4,968,222

[45] Date of Patent: Nov. 6, 1990

[54] RECIPROCATING COMPRESSOR WITH AN INTER COOLER FOR COOLING THE OPERATIONAL GAS

[75] Inventors: Tetsuya Gotou, Nagoya; Shintaro Harada, Nishio; Yoshihira Shiroshita, Toyoake, all of Japan

[73] Assignee: Aisin Seiki Kabushiki Kaisha, Kariya, Japan

[21] Appl. No.: 359,697

[22] Filed: May 31, 1989

[30] Foreign Application Priority Data

May 31, 1988 [JP] Japan ..... 63-134919

[51] Int. Cl.[5] ..... F04B 39/06

[52] U.S. Cl. ..... 417/313; 417/243

[58] Field of Search ..... 417/243, 313, 415, 570

[56] References Cited

U.S. PATENT DOCUMENTS 1,062,405 5/1913 Koster ..... 417/243

FOREIGN PATENT DOCUMENTS 872119 5/1942 France ..... 417/243

59-185883 10/1984 Japan .

*Primary Examiner*—John C. Fox

*Attorney, Agent, or Firm*—Burns, Doane, Swecker & Mathis

[57] ABSTRACT

Reciprocating type compressor which includes a cylinder having an inner bore, a piston reciprocating in the inner bore, an inter cooler adjacent a compression space which is formed in the inner bore by the piston and an operational gas passage and a refrigerant passage arranged in heat-exchanging relationship. An inlet valve is located adjacent to the compression space for controlling the introduction of operational gas in response to an intake stroke of the piston, and an outlet valve is arranged adjacent to the inter cooler so as to discharge the operational gas via the inter cooler in response to a discharge stroke of the piston. The refrigerant passage is ring-shaped and defines a longitudinal axis coinciding with an axial center of the inner bore. The operational gas passage includes a plurality of conduits for conducting operational gas from the compression space. The conduits include inlet ends disposed opposite the compression space and outlet ends disposed opposite the outlet valve.

11 Claims, 4 Drawing Sheets

RECIPROCATING COMPRESSOR WITH AN INTER COOLER FOR COOLING THE OPERATIONAL GAS

BACKGROUND OF THE INVENTION

1. Field of the Invention

The present invention relates generally to a compressor, and more particularly to a reciprocating type compressor having an inter cooler.

2. Description of the Prior Art

Operational gases which are compressed by a compressor, such as a reciprocating piston type of compressor, are typically heated as a result of the work applied thereto during the compression process. Heating of the gas is disadvantageous, because it reduces the density of the gas, thus reducing the amount of work output (i.e., compressor performance is adversely affected). Also, the heating of the gas can adversely affect the performance and endurance of seal members which may be contacted by the gas.

A conventional reciprocating type compressor is disclosed, for example, in Japanese Patent laid open Publication No. 59-185883 published on Oct. 22, 1984. This conventional reciprocating compressor includes an inter cooler interposed between a cylinder and a cylinder head. A compression space is defined between the cylinder head and a reciprocable piston disposed in a bore of the cylinder. The inter cooler defines a refrigerant passage through which a refrigerant is conducted. A gas inlet for operational gas is provided, the inlet communicating with an inlet valve which, in turn, communicates with the compression space to conduct operational gas into the compression space in response to an intake stroke of the piston. A gas outlet is provided for discharging operational gas during a discharge stroke of the piston. That gas outlet communicates with an outlet valve which, in turn, communicates with the compression space.

In one embodiment, the refrigerant passage overlies at least a substantial portion of the cross section of the cylinder bore, and a plurality of narrow, i.e., small-diameter conduits extend through that passage in heat-exchange relationship therewith. A first group of those conduits communicates the inlet valve with the compression space, and the group of remaining conduits communicates the compression space with the outlet valve. During the piston intake stroke, incoming gas passes through the first group of conduits and is cooled; during the piston exhaust stroke the discharging gas passes through the second group of conduits and is cooled. The cooling of the gas tends to offset any heating of the gas occurring as a result of the work applied thereto during the compression process, thereby alleviating the above-discussed disadvantages associated with such heating.

However, since both the inlet and outlet valves communicate with the compression space via narrow conduits, a drawback occurs. That is, during a discharge stroke of the piston, some of the operational gases will be forced into those of the narrow conduits which communicate with the inlet valve and thus will not be discharged. The volumes of those narrow conduits thus constitute dead air spaces which reduce compressor efficiency. Also, during a piston intake stroke, a large pressure loss results from the fact that the incoming gases are restricted to pass through the narrow conduits.

Further, in the above-described conventional reciprocating type compressor, since the cross-sectional area of the refrigerant passage taken in a direction perpendicular to the narrow conduits of the inter cooler is relatively large, the flow speed of the refrigerant is relatively low. Therefore, there occurs a drawback in that the rate of the cooling of the operational gas by the inter cooler is also relatively low. While such cross-sectional area can be reduced by increasing the number or the diameter of the conduits for the operational gas, the flow speed of the operational gas becomes reduced as a consequence and the rate of cooling of the operational gas by the inter cooler remains low.

In another embodiment of the above-referenced publication, the refrigerant passage overlies only a portion (e.g., about one-half) of the compression space, the remainder thereof being overlain by the inlet valve. Thus, only the outlet valve communicates with the compression space via the narrow conduits. While such an embodiment alleviates the above-discussed drawback relating to dead air space, it would not alleviate the drawback relating to a low cooling rate. In fact, since the volume of the refrigerant passage is decreased (as compared with the first embodiment), the overall cooling rate would be further reduced.

SUMMARY OF THE INVENTION

It is, therefore, an object of the present invention to improve the efficiency of the compressor while maintaining a high rate of cooling.

It is another object of the present invention to provide a smooth flow of the operational gas when the operational gas is discharged.

It is a further object of the present invention to provide an improved reciprocating type compressor which includes a cylinder having an inner bore, a piston movably and sealingly fitted into the inner bore and reciprocating therein. An inter cooler is disposed adjacent to a compression space and includes an operational gas passage formed therein. An inlet valve disposed adjacent to the compression space controls the introduction of operational gas in response to the reciprocating motion of the piston. An outlet valve disposed adjacent the inter cooler discharges the operational gas from the compression space via the inter cooler in response to the reciprocating motion of the piston. The refrigerant passage is circularly formed in the inter cooler about an axial center aligned with the axis of the inner bore. The operational gas passage comprises a plurality of conduits communicating with the compression space. One end of each conduit is formed in a face of the inter cooler opposing the compression space. The outlet valve comprises a plurality of valve openings disposed adjacent to the other ends of the operational gas passages. All of the conduits are employed to conduct discharging operational gas.

BRIEF DESCRIPTION OF THE DRAWINGS

Additional objects and advantages of the present invention will become more apparent from the following detailed description of preferred embodiments thereof when considered with reference to the attached drawings, in which.

DESCRIPTION OF THE PREFERRED EMBODIMENTS

A reciprocating type compressor constituted in accordance with preferred embodiments of the present invention will be described with reference to the drawings.

Figure 1:
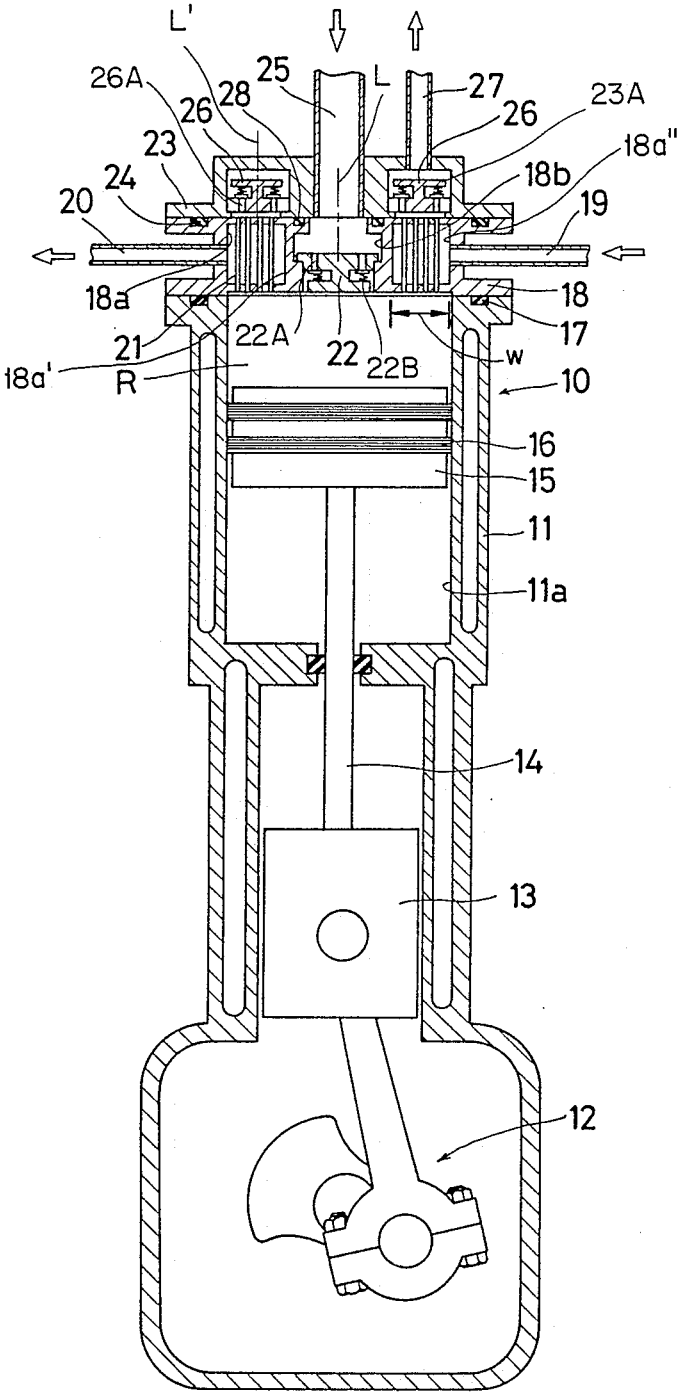
FIG. 1 is a sectional view of a first embodiment of a reciprocating type compressor in accordance with the present invention.

Referring to FIG. 1, there is a schematically illustrated a reciprocating type compressor 10 for use with a cooling apparatus and which includes a cylinder 11 having a bore 11*a*. A piston 15 is gas-tightly fitted into the bore 11*a* via piston rings 16. The piston 15 performs a reciprocating motion in the bore 11*a* by a crank mechanism 12 via a guide piston 13 and a connecting rod 14.

An inter cooler 18 which has a plate-shape is gas-tightly and fluid-tightly disposed at an open end of the inner bore 11*a* of the cylinder 11 via a seal member 17. Thereby, a compression space R which is a sealed space is formed between the inter cooler 18 and the piston 15 in the bore 11*a*. A circular ring-shaped refrigerant passage 18*a* is formed in the inter cooler 18 by radially spaced inner and outer surfaces 18*a*', 18*a*'', and an inlet conduit 19 and an outlet conduit 20 are symmetrically formed therein with respect to a longitudinal axis L of the ring-shaped passage 18*a* which coincides with the center axis of the bore 11*a*. The inlet conduit 19 and the outlet conduit 20 communicate with the circular refrigerant passage 18*a*, respectively, and a refrigerant such as water, freon, etc. is circulated from the inlet conduit 19 to the outlet conduit 20 via the circular refrigerant passage 18*a* for cooling the operational gas such as helium in the compression space R.

Extending through the circular refrigerant passage 18*a* are operational gas passages 21 which comprise a plurality of narrow (i.e., small diameter) tubular conduits disposed transversely with respect to the flow direction of the refrigerant. One end of each of the operational gas passages 21 communicates with the compression space R. The operational gas passages 21 are symmetrically formed with respect to a line which connects the coaxially arranged inlet and outlet conduits 19. Disposed in an inner recess 18*b* of the inter cooler 18 is an inlet valve assembly 22 which introduces operational gas into the compression space R in response to the an intake stroke of the piston 15. A cylinder head 23 is gas-tightly disposed on the inter cooler 18 via a seal member 24. The cylinder head has a circular space 23A and the ends of the conduits 21 opposite the compression space R communicate with the space 23A at equally spaced intervals. The operational gas is introduced from an inlet passage 25 which is formed in the cylinder head 23 and which communicates with the inlet valve 22. The inlet valve assembly 22 comprises a valve body which is fixed to the inter cooler 18 and a plurality of apertures 22A formed in the body. The apertures are closed by spring-biased valve elements 22B, the springs urging the valve member toward the closed position.

A plurality of outlet valve assemblies 26 is provided which discharges the operational gas out of the compression space R in response to a discharge stroke of the piston 15. Each outlet valve assembly 26 is installed in the cylinder head 23 so as to oppose the proximate ends of the operational gas passages 21. The operational gas is discharged via the outlet valve assemblies 26 and an outlet passage 27 which is formed in the cylinder head 23 and which is gas-tightly separated from the inlet passages 25 by a seal member 28. Each outlet valve assembly 26 is similar to the valve assembly 22 in that it comprises valve bodies which are fixed in the circular space of the cylinder head and spring-biased elements which open and close apertures 26A formed in the valve bodies. The springs urge the valve elements toward the closed position. The apertures 26A of each outlet valve assembly (only two apertures being depicted in FIG. 1) are formed equidistantly from a longitudinal axis L' of the body, e.g., in a circular pattern about the axis L'. The conduits 21 are arranged in clusters adjacent the respective outlet valve assemblies 26. That is, a plurality of conduits is arranged in a circular pattern about the axis L' at about the same radius as the apertures 26A. Thus, for each outlet valve assembly 26 there is provided a cluster of conduits 21. Such an arrangement produces a relatively smooth flow of operational gas from the conduits to the apertures 26A, i.e., turbulence is minimized.

When the piston 15 is downwardly moved by the crank mechanism 12 whereupon the pressure in the compression space R lowers, the inlet valve assembly 22 is opened and the operational gas is introduced from the inlet passage 25 into the compression space R via the inner bore 18*b* of the inter cooler 18. Next, when the piston 15 begins to move upwardly, the inlet valve assembly 22 closes. When the piston 15 is further upwardly moved and the pressure in the compression space R reaches a predetermined value, the outlet valve assembly 26 opens and the operational gas which is compressed in the compression space R is discharged via the operational gas passage 21 and the outlet passage 27.

In this cycle, the operational gas whose temperature is raised by the compression, exchanges heat with the refrigerant flowing in the circular refrigerant passage 18*a* when the operational gas passes through the operational gas passages 21 and is thereby cooled. Since an increase of the temperature of the operation gas is minimized or avoided, the operation gas will not become appreciably less dense. Hence, the piston output work will not be appreciably decreased, and the seals will not be adversely affected with regard to performance or endurance.

Since the refrigerant passage 18*a* is ring-shaped, the cross-sectional width W of that passage as viewed in FIG. 1 becomes reduced, whereby the velocity of regrigerant flow is increased to increase the cooling rate. Furthermore, the overall area of the passage 18*a* (across width 2W) is not appreciably reduced, whereby the number of conduits 21 need not be reduced. In fact, the ring-shape may make it easier to maximize the number of conduits 21. Stated otherwise, the ring-shape passage 18*a* is long (endless) and narrow as compared for example to the wide and short passage of FIG. 3 of the aforediscussed Japanese document 59-185883. Thus, the refrigerant flow velocity is increased in the passage 18*a* without appreciably reducing the overall area of the passage 18*a* so that an ample number of conduits 21 can be used. In effect, the ratio of that surface area of the conduits 21 to the cross-sectional area of passage 8*a* (of width W) is increased in accordance with the present invention to maximize the cooling rate.

Further, since the outlet valve assemblies 26 are positioned right above the clusters of operational gas passages 21, which passages conduct only discharging gas, the dead air space is further reduced, and the flow of the operational gas is smooth. Therefore, the pressure loss becomes small and the flow quantity of the operational gas which is discharged under the predetermined pressure increases, and the efficiency of the compressor is improved.

Figure 2:
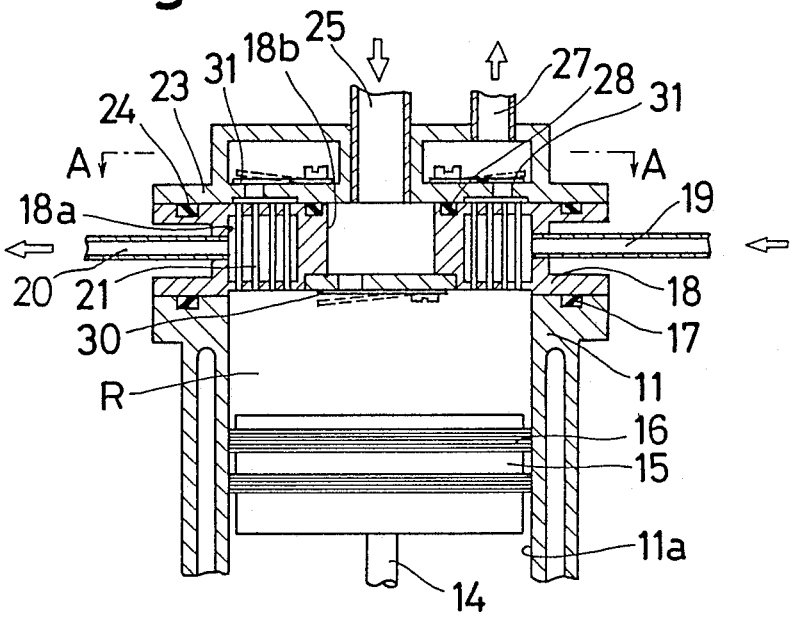
FIG. 2 is a partly sectional view of a second embodiment of a reciprocating type compressor in accordance with the present invention.
Figure 3:
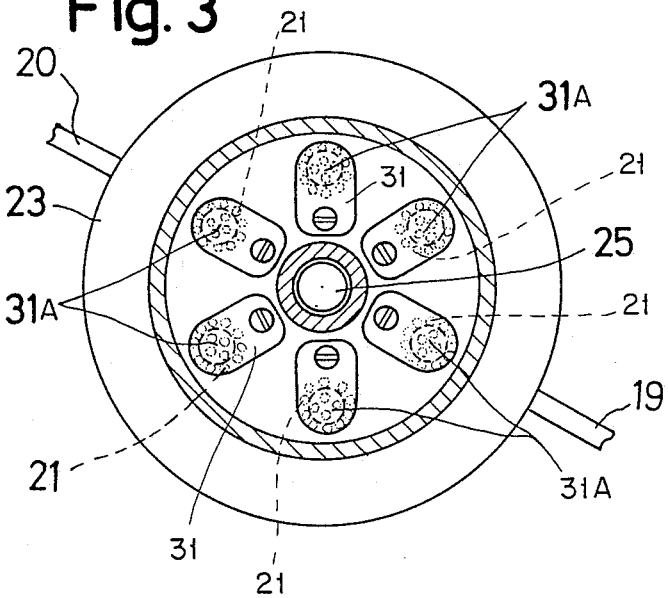
FIG. 3 is a sectional view taken substantially along the line A—A of FIG. 2.

FIG. 2 and FIG. 3 show a second embodiment of the present invention. In this embodiment, inlet and outlet valve assemblies 30, 31 are constituted by leaf springs. The leaf spring of the inlet valve assembly 30 is operated so as to close and open an aperture formed in the valve body. The leaf springs of the outlet valve assemblies 31 are operated so as to close and open apertures formed in the cylinder head 23. Thus, in this embodiment, it is possible to minimize the size of both valve assemblies. From FIG. 3 it is apparent that the conduits 21 are clustered about apertures 31A of the respective outlet valve assemblies, as in the embodiment according to FIG. 1.

Figure 4:
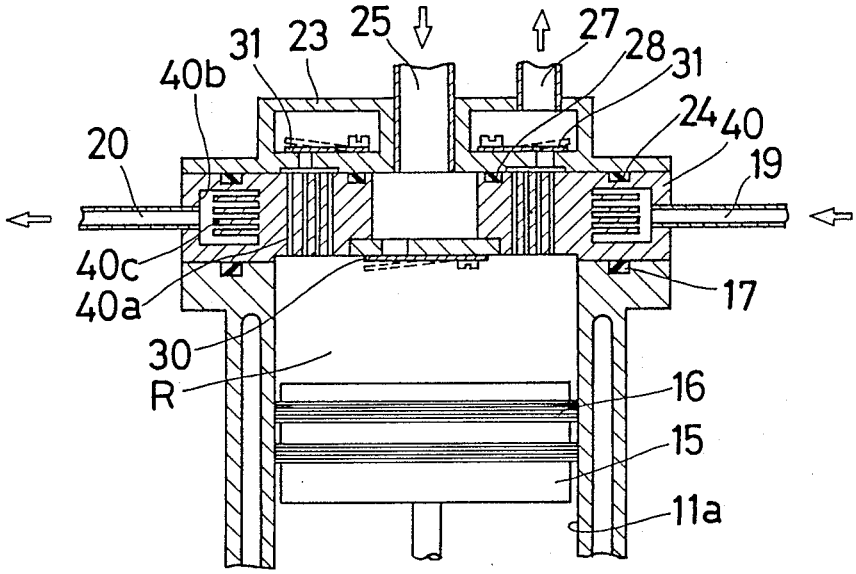
FIG. 4 is a partly sectional view of a third embodiment of a reciprocating type compressor in accordance with the present invention.

FIG. 4 shows a third embodiment of the present invention. In this embodiment, an inter cooler 40 is made of material having a high heat transfer rate (for example, copper, etc.), and the operational gas passages 40*a* are formed in the inter cooler 40 as thin holes. Further, in this embodiment, the circular refrigerant passage 40*b* which has many fins 40*c* at its inner surface is formed in the inter cooler 40 so as to surround the operational gas passages 40*a*. According to this embodiment, since the operational gas passages 40*a* are separated from the circular refrigerant passage 40*b*, the structure is simple and can be easily fabricated.

Figure 5:
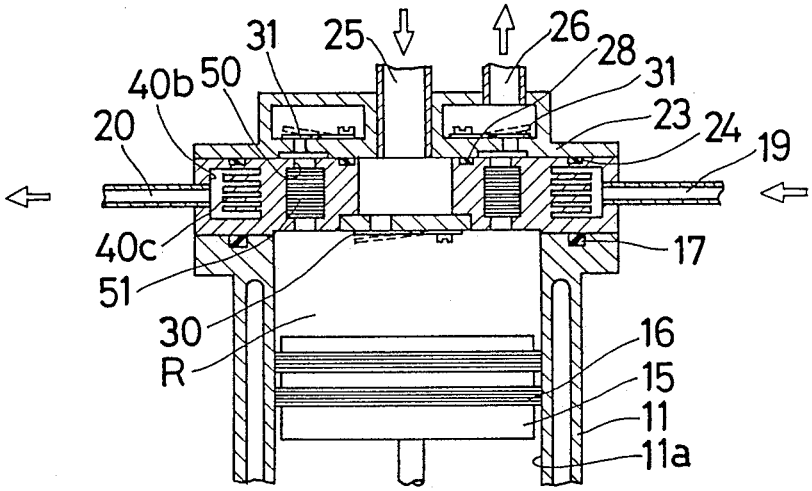
FIG. 5 is a partly sectional view of a fourth embodiment of a reciprocating type compressor in accordance with the present invention.

FIG. 5 shows a fourth embodiment of the present invention. In this embodiment, an inter cooler 40 is made of material having a high heat transfer rate (for example, copper, etc.), and the operational gas passages 50 are formed in the inter cooler 40 in the form of large diameter holes. A metalmesh arrangement 51 is disposed in each of the operational gas passages 50. Therefore, according to this embodiment, the contacting area of the operational gas is increased and the effect of the cooling of the operational gas is further improved. The metal mesh arrangement 51 comprises a plurality of mesh elements stacked in each the gas passage 50.

Figure 6:
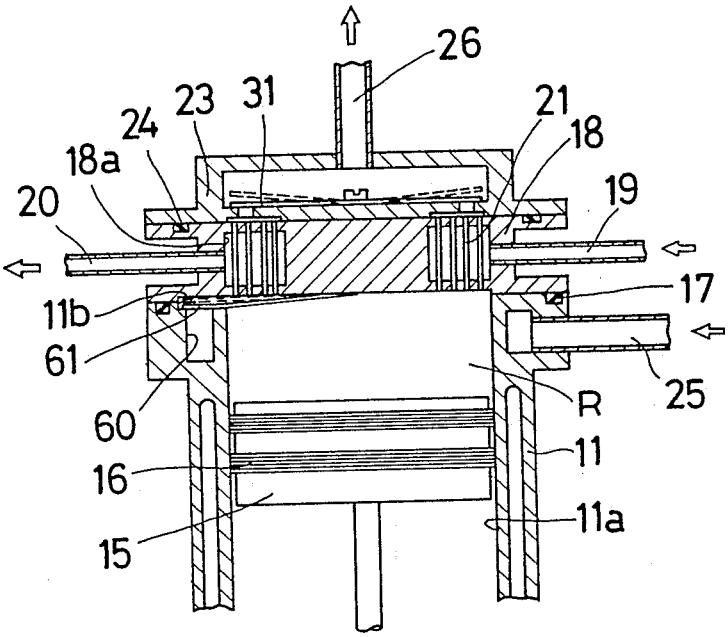
FIG. 6 is a partly sectional view of a fifth embodiment of a reciprocating type compressor in accordance with the present invention.

FIG. 6 shows a fifth embodiment of the present invention. In this embodiment, an inlet passage 60 of the operational gas is circularly formed in the cylinder 11 so as to surround the inner bore 11*a*. A part of the inlet passage 60 is opened to a concave portion 11*b* which is formed in the face of the cylinder 11 opposing the inter cooler 18 so as to communicate with the inner bore 11*a*. An inlet valve 61 which is constituted by a plate spring is disposed in the concaved portion 11*b* so as to open and close an opening of the inlet passage 60. According to this embodiment, the area of the inlet passage of the operational gas to the compression space R is enlarged without increasing the size of the dead zone and without restricting the position of the inlet valve. Therefore, the inlet efficiency improves and the overall efficiency of the compressor can be improved. Further, the outlet valves assembly 31 includes only a single spring.

In accordance with the present invention, the size of the dead air space capacity which is formed between the inter cooler and the inlet valve or the outlet valve can be minimized. Therefore, the efficiency of the compressor can be improved. Further, since the equivalent diameter of the refrigerant is decreased by the increasing the rate of the heat transfer area in the sectional area of the flow of the refrigerant passage of the square direction with respect to the flow direction of the operational gas without the lowering the flow speed of the operational gas without the lowering the flow speed of the operation gas, the heat transfer rate becomes large and it is able to improve the effect of the cooling of the operational gas.

Further, according to the present invention, the discharge flow of the operational gas is smooth so as to decrease the pressure loss and further improve the efficiency of the compressor.

Although certain specific embodiments of the present invention have been shown and described, it is obvious that many modifications thereof are possible. For example, the conduits 21 could be arranged to conduct operational gas into (rather than from) the compression space. That is, the valve 26 would be an inlet valve, and 22 would be an outlet valve. The present invention, therefore, is not intended to be restricted to exact showing of the drawings and description thereof, but is considered to include reasonable and obvious equivalents.

What is claimed:

1. A reciprocating type compressor comprising:

a cylinder having an inner bore, a piston movably and sealingly fitted into said inner bore and reciprocating in said inner bore, an inter cooler adjacent to a compression space which is formed in said inner bore by said piston and including operational gas passage means communicating with said compression space, and refrigerant passage means, said operational gas passage means and refrigerant passage means arranged in a heat-exchanging relationship, inlet valve means located adjacent said compression space and controlling the introduction of operational gas thereto in response to an intake stroke of said piston, a plurality of outlet valves located adjacent to said inter cooler so as to discharge operational gas from said compression space via said inter cooler in response to a discharge stroke of said piston, said refrigerant passage means being formed as ring-shaped by radially spaced inner and outer surfaces, said ring-shaped passage means defining a longitudinal axis aligned with a center axis of said inner bore, said operational gas passage means comprising a plurality of conduits extending through said ring-shaped refrigerant passage means for conducting operational gas from said compression space, said conduits including inlet ends and outlet ends, said inlet ends opposing said compression space, said outlet valves arranged opposite said outlet ends of said conduits such that all of said conduits are utilized for conducting operational gas away from said compression space.

2. A reciprocating type compressor as recited in claim 1, wherein said inlet valve is disposed in a center of said inter cooler.

3. A reciprocating type compressor as recited in claim 1, wherein said conduits extend through said refrigerant passage means perpendicularly to a plane defined by said refrigerant passage means.

4. A reciprocating type compressor as recited in claim 3, further comprising inlet and outlet conduits opening into said refrigerant passage means at symmetrical positions with respect to said longitudinal axis of said inner bore, said conduits being symmetrical and spaced at equal intervals with respect to a line which interconnects said inlet and outlet conduits.

5. A reciprocating type compressor as recited in claim 2, further comprises a plurality metal meshes stacked in said conduits, said refrigerant passage means formed in said inter cooler so as to surround said conduits.

6. A reciprocating type compressor as recited in claim 5, wherein said conduits are spaced from said refrigerant passage means.

7. A reciprocating type compressor as recited in claim 1, wherein said refrigerant passage means has a plurality of fins on an inner circumference thereof.

8. A reciprocating type compressor according to claim 1 including an inlet passage for conducting operational gas to said conduits, said inlet passage being disposed in a wall of said cylinder at a location spaced longitudinally from said intercooler.

9. A reciprocating type compressor according to claim 8, wherein said inlet valve means is mounted in said cylinder for communicating said inlet passage with said compression space.

10. A reciprocating type compressor according to claim 9, wherein said valve comprises a leaf spring.

11. A reciprocating type compressor according to claim 9, wherein said inlet passage coaxially surrounds said inner bore.

* * * * *